United States Patent [19]

Mannato

[11] Patent Number: 4,876,863

[45] Date of Patent: Oct. 31, 1989

[54] LOCK PARTICULARLY ADAPTED FOR BAGS, BRIEF-BAGS, OR THE LIKE

[75] Inventor: Pietro Mannato, Bologna, Italy

[73] Assignee: Finduck S.r.l., Bologna, Italy

[21] Appl. No.: 215,969

[22] Filed: Jul. 7, 1988

[30] Foreign Application Priority Data

Jul. 8, 1987 [IT] Italy ..... 15204/8 [U]

[51] Int. Cl.[4] ..... E05B 65/52

[52] U.S. Cl. ..... 70/64; 70/67; 70/69; 70/76

[58] Field of Search ..... 70/64–76; 292/DIG. 50

[56] References Cited

U.S. PATENT DOCUMENTS

| | | | |
|---|---|---|---|
| 298,451 | 5/1884 | Deimel | 70/64 X |
| 400,624 | 4/1889 | Yarger | 292/DIG. 50 X |
| 407,042 | 7/1889 | Strattan | 70/66 |
| 693,251 | 2/1902 | Finn | 70/64 |
| 1,264,709 | 4/1918 | Sugiyama | 70/64 |
| 2,161,519 | 6/1939 | Loftin et al. | 70/70 X |
| 2,177,506 | 10/1939 | Wachs et al. | 292/DIG. 50 X |
| 2,192,374 | 3/1940 | Fritz | 292/DIG. 50 X |
| 2,300,509 | 11/1942 | Komenak | 70/76 |
| 3,147,607 | 9/1964 | Calvano et al. | 70/64 |
| 3,186,198 | 6/1965 | Sudhaus | 292/DIG. 50 X |
| 3,236,076 | 2/1966 | Wellekens | 70/168 X |
| 3,275,362 | 9/1966 | Jacobson | 292/DIG. 50 X |
| 3,394,959 | 7/1968 | Hoffman | 70/64 X |

FOREIGN PATENT DOCUMENTS

| | | | |
|---|---|---|---|
| 699904 | 11/1940 | Fed. Rep. of Germany | 70/67 |
| 924172 | 3/1947 | France | 292/DIG. 50 |
| 942557 | 2/1949 | France | 70/64 |
| 63389 | 9/1955 | France | 292/DIG. 50 |
| 19077 | 10/1890 | United Kingdom | 70/70 |
| 300020 | 11/1928 | United Kingdom | 70/76 |
| 323280 | 1/1930 | United Kingdom | 70/76 |

*Primary Examiner*—Gary L. Smith
*Assistant Examiner*—Suzanne L. Dino
*Attorney, Agent, or Firm*—Pollock, Vande Sande & Priddy

[57] ABSTRACT

Lock for bags or the like, comprising a first part (7, 10) affixed to the bag (F) and a second part (1) which is associated with a closure flap (P) to be secured to the bag (F) by means of the lock. The second part is in the form of a slot (1) close to the edge of the closure flap (P), and the first part comprises a supporting platelet (7) attached to the bag (F) and carrying a rotatable locking barrel (13) which projects from the front side of the supporting platelet (7) and is formed with at least one lateral projection (14, 144) at its free end (113). To the end (107) of the supporting platelet (7), which is turned toward the closure flap (P), is hinged a latch wing (10) formed with a circular opening (11) of a diameter which corresponds to the diameter of the free end (113) of the locking barrel (13), which opening (11) has one or more recesses (12, 12') mating with the lateral projections (14, 14') in the locking barrel.

4 Claims, 1 Drawing Sheet

LOCK PARTICULARLY ADAPTED FOR BAGS, BRIEF-BAGS, OR THE LIKE

FIELD OF THE INVENTION

The invention concerns a lock particularly adapted for bags, brief-bags, or any like article, and comprising a part which is fixed to the bag and a part which is associated with a closure flap of the bag to be secured to the bag by means of the lock.

SUMMARY OF THE INVENTION

The object of the invention is to provide a lock of the aforementioned kind, which is of a relatively small size, and comprises a reduced number of structural elements, and is simple and strong in construction, so that it guarantees safe latching, i.e., a reliable locking of the closure flap to the bag.

This object is achieved by the feature that the part of the lock associated with the closure flap is in form of a slot close to the edge of the closure flap, and the part of the lock associated with the bag comprises a supporting platelet attached to the bag and carrying a rotatable locking barrel which projects from the front side of the supporting platelet and is formed with at least one lateral projection at its free end, and with means enabling the locking barrel to be turned, to the end of the supporting platelet, which is turned toward the closure flap, there being hinged a latch wing formed with a circular opening of a diameter which corresponds to the diameter of the free end of the locking barrel, which opening is provided with one or more recesses mating with the lateral projection or projections in the locking barrel. The arrangement is such that the latch wing can be passed through the slot in the closure flap, and by the opening in the latch wing, this latch wing can be then fitted on the locking barrel, to which the same can be secured by turning the locking barrel so as to angularly offset the lateral projection or projections in the locking barrel relative to the respective recesses in the latch wing, and so as to place the said projection or projections upon the latch wing.

BRIEF DESCRIPTION OF THE DRAWINGS

One embodiment of the lock according to the invention will be now described by referring to the accompanying drawings, in which.

DESCRIPTION OF THE PREFERRED EMBODIMENTS

Figure 5:
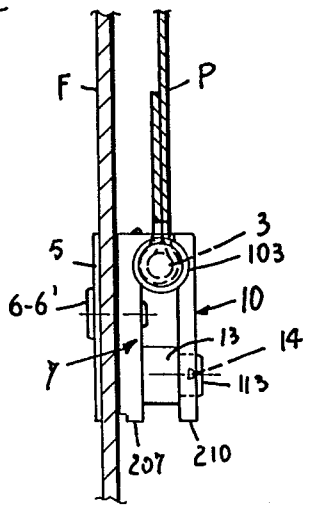
FIG. 5 is a side elevation view of the lock in locking position.
Figure 1:
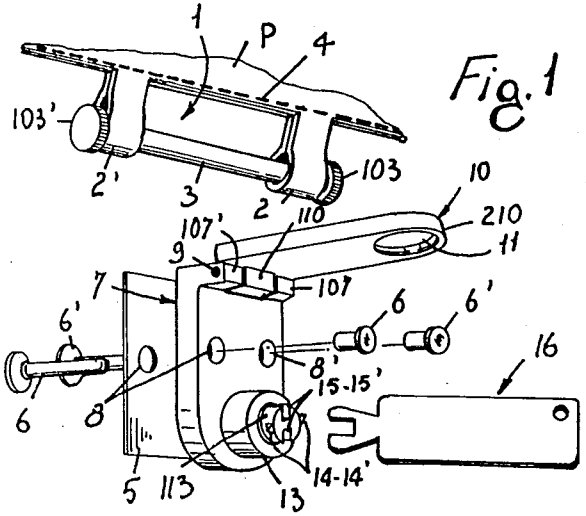
FIG. 1 is an exploded view showing the several components of the lock.

As shown in FIGS. 1 and 5, the edge of the closure flap P which is to be movably attached to the body F of a bag is provided in median position or in any other suitable position with a suitably sized slot 1 made, for example, in the following manner. The closure flap P is made as a whole or only at its end portion of a strip of leather which in median position is formed with a rectangular or square aperture and at the sides thereof with apertures which are open at their ends, the arrangement being such that by book-like folding the said strip along the longitudinal median axis of said apertures, the said strip will be provided in median position with two protruding rings 2, 2' into which are previously inserted the ends of a metal pin 3 provided with projections 103—103' holding the same anchored to the said rings, which in turn are closed by means of an adhesive and a near sewing 4, The slot 1 is thus delimited by the pin 3, the inner sides of rings 2, 2' and the lower edge of the closure flap P.

It is, however, to be understood that the slot 1 in the closure flap P may be made with any other suitable means other than the one described, for example, by adding to the closure flap P an annular element, or by making the slot directly in the closure flap by means of cuts, or by providing the slot with a suitable metal trim.

FIGS. 1 and 5, show that, by means of an internal strengthening platelet 5 and rivets 6—6', a rectangular supporting plate 7 is attached to the outside of the bag F, its longitudinal axis being oriented perpendicularly to the said pin 3, so as to cross the same along its axis. The width of the supporing plate 7 is not much smaller than the length of the free section of pin 3.

The supporting plate 7 has a rounded lower end 207. Aligned bores 8, 8' are provided in the supporting plate 7 and in the platelet 5, and receive fastening rivets 6—6'. The upper end of supporting plate 7 is provided with two equal opposite projections 107, 107' unitary therewith, which protrude at right angles from the visible face and from the upper end of the supporting plate 7.

Between the projections 107, 107' there is hinged, by means of pin 9, the projection 110 of a latch wing 10, which extends perpendicularly to the non-rounded end of plate 7 and in plan view has a shape like that ot the supporting plate 7, being also rounded at its free end 210. The latch wing 10 may be less thick than the supporting plate 7.

In its rounded end 210, the latch wing 10 is provided in centered position with a circular through bore 11 having at its interior a protruding rim with diametrically opposite recesses 12—12'.

Figure 4:
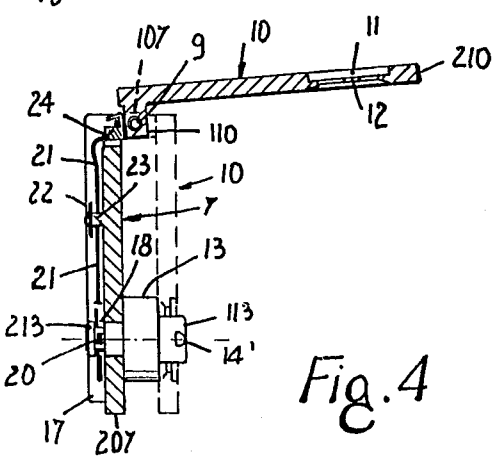
FIG. 4 is a sectional view of the lock, taken on the line IV—IV in FIGS. 2 and 3.

When the latch wing 10 is swung about the pin 9 toward the supporting plate 7, as shown by dash lines in FIG. 4, the circumference of bore 11 comes into contact with the fore end of a cylindrical locking barrel 13 which is rotatably mounted on the rounded end portion 207 of the supporting plate 7, and is integrally and coaxially provided with a projecting cylindrical portion 113 engaging with play the said bore 11, and slightly protruding therefrom.

The projecting portion 113 of the locking barrel 13 is provided with two diametrically opposite lateral appendices 14—14' which pass through the said recesses 12—12' and which come to be positioned, when the barrel 13 is turned, over the rim, thus fastening the latch wing 10 to the supporting plate 7.

When, before swinging the latch wing 10 toward the supporting plate 7, the latch wing 10 is passed through the slot 1 in the closure flap P, in the aforesaid following locking operation the pin 3 is enclosed between the supporting plate 7 and the latch wing 10, whereby the flap P is fastened by the body F of the bag (FIG. 5).

Figure 2:
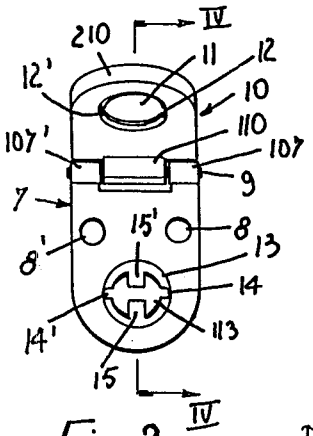
FIG. 2 is a front elevational view showing the opened lock in open position.

As shown in FIGS. 1 and 2, the projecting portion 113 of the locking barrel 13 is provided with recesses 15—15' which are spaced at 90° from the lateral projections 14—14', and into which can be inserted the prongs of a fork key 16 supplied with the lock. By means of this small key 16, it is easy to act upon that side of the projecting portion 113 which is accessible through the bore 11, and to turn the locking barrel 13.

Figure 3:
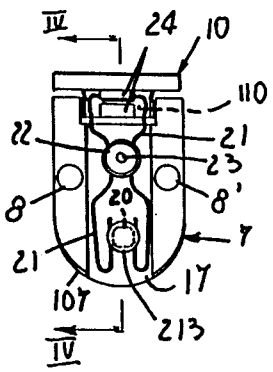
FIG. 3 is a rear elevational view showing the opened lock in open position.

As shown in FIGS. 3 and 4, the supporting plate 7 is provided in its back side with an intermediate longitudinal recess 17 from which the axial pin 213 of the locking barrel 13 protrudes with its groove 18, which pin is rotatably passed through a bore 19 in the said supporting plate 7. The groove 18 has four angularly equispaced, secant flattened portions 20 which are suitably oriented with respect to the appendices 14—14'. Housed within the said groove 18 are the ends of a wire fork spring 21 which axially holds the pin 213 in the bore 19 and which, when the barrel 13 is turned, snappingly acts upon the flatted portions 20, and stabilizes the said barrel after every 90° rotation, so that the appendices 14—14 are kept either in line with, or offset by 90° from, the recesses 12—12' provided in the rim 111 of bore 10.

The wire fork spring 21 has its intermediate portion fastened to the bottom of the recess 17 by means of a washer 22 which is placed upon the said spring and is fitted on a pin 23 unitary with the supporting plate 7, and riveted.

The curved upper end of spring 21 is attached to a pad 24 which is partly fastened on to the said spring, and whose flat face cooperates with the flat faces of the projection 110, thus firmly holding the latch wing 10 in opened position as shown in FIGS. 1, 2 and 4 or in closed condition as shown in FIG. 5.

I claim:

1. A lock for a bag having a closure flap to be secured to said bag, said lock comprising:

(a) a slot (1) adjacent an edge of said closure flap (P);

(b) a supporting platelet (7) attached to said bag (F);

(c) a rotatable locking barrel (13) projecting from a front side of said platelet (7) and having at least one lateral projection (14—14') at a free end of said barrel, with side recesses (15, 15') in said free end, and a matching key (16) engageable in said side recesses for rotating said locking barrel;

(d) a latch member (10) pivotally hinged to an end (107) of said platelet (7) turned toward said closure flap (10), said latch member having a circular opening (11) diameter corresponds to the diameter of a free end (113) of said locking barrel (13), said opening having at least one recess (12, 12') mating with said at least one lateral projection (14, 14') on said locking barrel;

(e) wire fork spring means (20, 21) attached to a rear side of said platelet (7), for stabilizing said locking barrel (13) in a first angular position in which said at least one lateral projection (14, 14') coincides with said at least one recess (12, 12'), and in at least another angular position in which said at least one lateral projection is angularly offset relative to said at least one recess, said locking barrel (13) having a stepped rear end (213) rotatably passing through said platelet (7) and axially retained by said wire fork spring means (21), said wire fork spring means having ends engaged in an annular groove (18) formed in said rear end (213) of said locking barrel (13);

(f) a bottom of said annular groove (18) being provided with angularly equispaced, secant flattened portions (20), said ends of said fork spring means (21) bearing against said bottom of said annular groove;

(g) whereby said latch member (10) can be passed through said slot (1) in said closure flap (P) and fitted on said locking barrel (13) by means of said opening (11), and secured to said locking barrel by rotating said locking barrel (13) to angularly offset said at least one lateral projection (14, 14') relative to said at least one recess (12, 12') and to place said at least one projection on said latch member (10).

2. A lock for a bag having a closure flap to be secured to said bag, said lock comprising (a) a slot (1) adjacent an edge of said closure flap (P);

(b) a supporting platelet (7) attached to said bag (F);

(c) a rotatable locking barrel (13) projecting from a front side of said platelet (7) and having at least one lateral projection (14—14') at a free end of said barrel, with side recesses (15, 15') in said free end, and a matching key (16) engageable in said side recesses for rotating said locking barrel;

(d) a latch member (10) pivotally hinged to an end (107) of said platelet (7) turned toward said closure flap (10), said latch member having a circular opening (11) whose diameter corresponds to the diameter of a free end (113) of said locking barrel (13), said opening having at least one recess (12, 12') mating with said at least one lateral projection (14, 14') on said locking barrel;

(e) wire fork spring means (20, 21) attached to a rear side of said platelet (7), for stabilizing said locking barrel (13) in a first angular position in which said at least one lateral projection (14, 14') coincides with said at least one recess (12, 12'), and in at least another angular position in which said at least one lateral projection is angularly offset relative to said at least one recess, said locking barrel (13) having a stepped rear end (213) rotatably passing through said platelet (7) and axially retained by said wire fork spring means (21), said wire fork spring means having ends engaged in an annular groove (18) formed in said rear end (213) of said locking barrel (13);

(f) a bottom of said annular groove (18) being provided with angularly equispaced, secant flattened portions (20), said ends of said fork spring means (21) bearing against said bottom of said annular groove;

(g) a hinged end (110) of said latch member (10) having two flat faces which are angularly offset relative to a hinge axis (9), a pad (24) cooperating with said flat faces, said pad, being attached to a transversal section of said fork spring means (21) located opposite to said ends of said fork spring means (21), so as to hold said latch member (10) in two angular positions, respectively parallel and perpendicular to said platelet (7);

(h) whereby said latch member (10) can be passed through said slot (1) in said closure flap (P) and fitted on said locking barrel (13) by means of said opening (11), and secured to said locking barrel by rotating said locking barrel (13) to angularly offset said at least one lateral projection (14, 14') relative to said at least one recess (12, 12') and to place said at least one projection on said latch member (10).

3. The lock according to claim 2, wherein the fork spring (21) is accomodated within a recess (17) in the back side of the supporting platelet (7) and is fastened to this platelet by means of a washer (22) which is superposed on the two arms of the fork spring (21) at an intermediate position thereon, and is secured to a riveted pin (23) which is integral with the said supporting platelet (17).

4. The lock according to claim 3, wherein the slot (1) in the closure flap (P) is delimited by a pin (3) which is parallel to the edge of the closure flap (P) and is passed through rings (2, 2') protruding from said edge of the closure flap (P) and formed of one piece with the said closure flap (P) or with a part added thereto, the said pin (3) being provided at its end with projections (103—103') axially holding the same in said rings (2, 2').

* * * * *